US005280903A

United States Patent [19]

Herrick, Jr.

[11] Patent Number: 5,280,903

[45] Date of Patent: Jan. 25, 1994

[54] SHEET JUSTIFIER

[75] Inventor: Robert F. Herrick, Jr., Deep River, Conn.

[73] Assignee: Roll Systems, Inc., Burlington, Mass.

[21] Appl. No.: 939,064

[22] Filed: Sep. 2, 1992

[51] Int. Cl.[5] ..... B65H 9/16

[52] U.S. Cl. ..... 271/251; 271/248

[58] Field of Search ..... 271/248, 249, 250, 251

[56] References Cited

U.S. PATENT DOCUMENTS

| | | | |
|---|---|---|---|
| 1,061,979 | 5/1913 | Burton | 271/253 X |
| 2,190,413 | 2/1940 | Davidson | 271/251 |
| 4,640,504 | 2/1987 | Garavuso et al. | 271/264 X |
| 4,674,375 | 6/1987 | Golicz | 83/91 |

FOREIGN PATENT DOCUMENTS

| | | | |
|---|---|---|---|
| 376554 | 7/1932 | United Kingdom | 271/250 |
| 2175573 | 12/1986 | United Kingdom | 271/248 |

*Primary Examiner*—H. Grant Skaggs
*Assistant Examiner*—Carol Lynn Druzbick
*Attorney, Agent, or Firm*—Wolf, Greenfield & Sack

[57] ABSTRACT

A sheet justifier provides a table having at least one rotational surface thereon that is substantially aligned with the table. A sheet is input to the table into contact with the rotational surface. A weighted ball is positioned over the rotating surface proximate an outer edge of the rotating surface. The sheet is grasped between the ball and the rotating surface and forced against a raised guide edge. Once the sheet is forced against the guide edge, all rotational driving force is translated in a downstream direction therealong so that the sheet is driven out of the guide edge with its edge aligned therewith in a justified orientation.

20 Claims, 16 Drawing Sheets

SHEET JUSTIFIER

FIELD OF THE INVENTION

The present invention relates to a device for justifying the edges of input sheets regardless of their orientation when input.

BACKGROUND OF THE INVENTION

It is often desirable to transfer sheets of, for example, paper between two devices, such as a printer and a further utilization device (e.g. a folder) without the need of a complex conveyor system. In general, such a conveyor system is necessary to prevent misalignment of sheet edges as they pass from one device to another. Misalignment of sheets can cause jams or otherwise lower the quality of the finished product.

Many printers and other sheet handling devices include ports from which sheets are output in serial order. Absent a complex coupling from the port to a further utilization device, these ports cannot be relied upon to output sheets in an aligned and justified manner.

In addition, sheets are often fed to a common path from a pair of slit and merged web. In this instance, sheet justification is highly desirable.

A user may also desire manual input of sheets to a device. A justifier can guarantee aligned feeding even when sheets are input rapidly by the user's hand.

It is therefore an object of this invention to provide a sheet justifier that can receive misaligned sheets from a port or other source, such as manual input, and aligned the edges of the sheets in a uniform justified manner. It is a further object of this invention to provide a sheet justifier that can be adapted to receive sheets from a variety of sources and that can be adapted to output sheets to a variety of utilization devices. It is yet another object of this invention to provide a sheet justifier that operates with increased reliability.

SUMMARY OF THE INVENTION

A sheet justifier according to this invention provides a supporting surface in the form a table having opposing ends for receiving sheets from an upstream port and outputting sheets to a downstream utilization device. A raised edge guide is provided along a substantial portion of one edge of the table, running along a sheet flow direction from upstream to downstream. A rotating surface, typically a disk, is provided adjacent the edge guide and substantially coplanar with the table surface. Near the outer edge of the disk, slightly upstream and adjacent the edge guide is provided a freely rotating mass such as a ball that is stationary relative to the disk but rotates in place in response to and following the rotation of the disk. An input sheet passing downstream between the ball and the disk is forced by the component of force perpendicular to the flow direction against the edge guide. The downstream component of force generated by disk rotation simultaneously forces the sheet to move downstream. The perpendicular component maintains the sheet against the edge and, thus, causes it to be output in a parallel justified orientation.

A plurality of rotating surfaces and balls can be aligned along the table to insure full justification of the sheet. The raised edge can be movable, as can the other justifier components, to produce jog offset sheets at selected times.

Additionally, a second freely rotating mass, such as a ball, can be provided between the axis of rotation and the more outwardly disposed ball in order to enable rotation of sheets so that each of their sides engage the raised edge guide. The second more inwardly disposed ball can be selectively applied to sheets to allow rotation of the sheet through a desired number of edges so that a desired orientation is obtained.

BRIEF DESCRIPTION OF THE DRAWINGS

The foregoing objects and other advantages of the invention will become more clear with reference to the following detailed description of the preferred embodiments as illustrated by the drawings in which.

DETAILED DESCRIPTION

Figure 1:
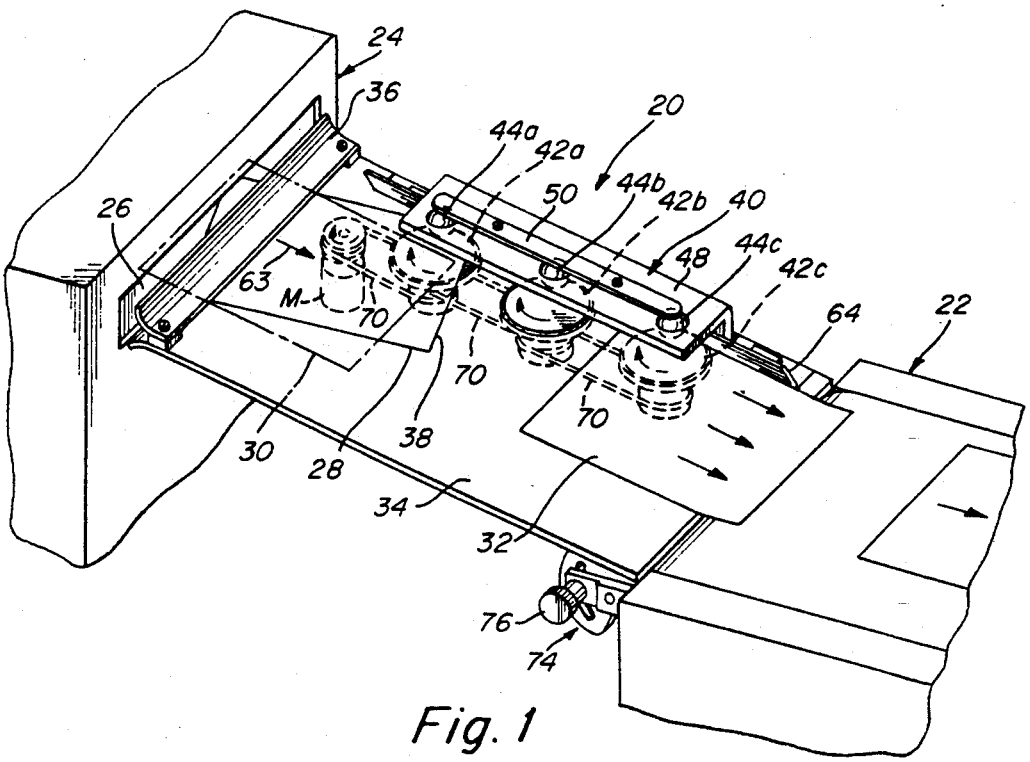
FIG. 1 is a perspective view of a sheet justifier according to a preferred embodiment.
Figure 2:
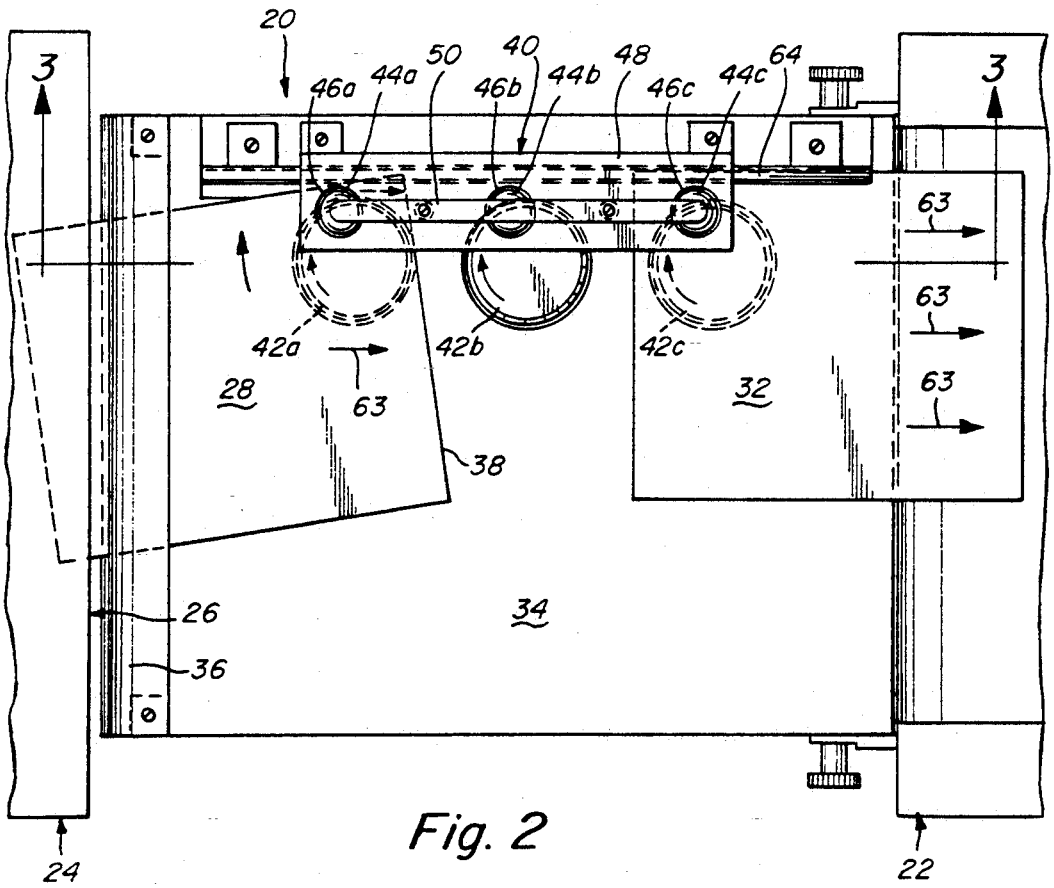
FIG. 2 is an exposed top view of the sheet justifier of FIG. 1.
Figure 3:
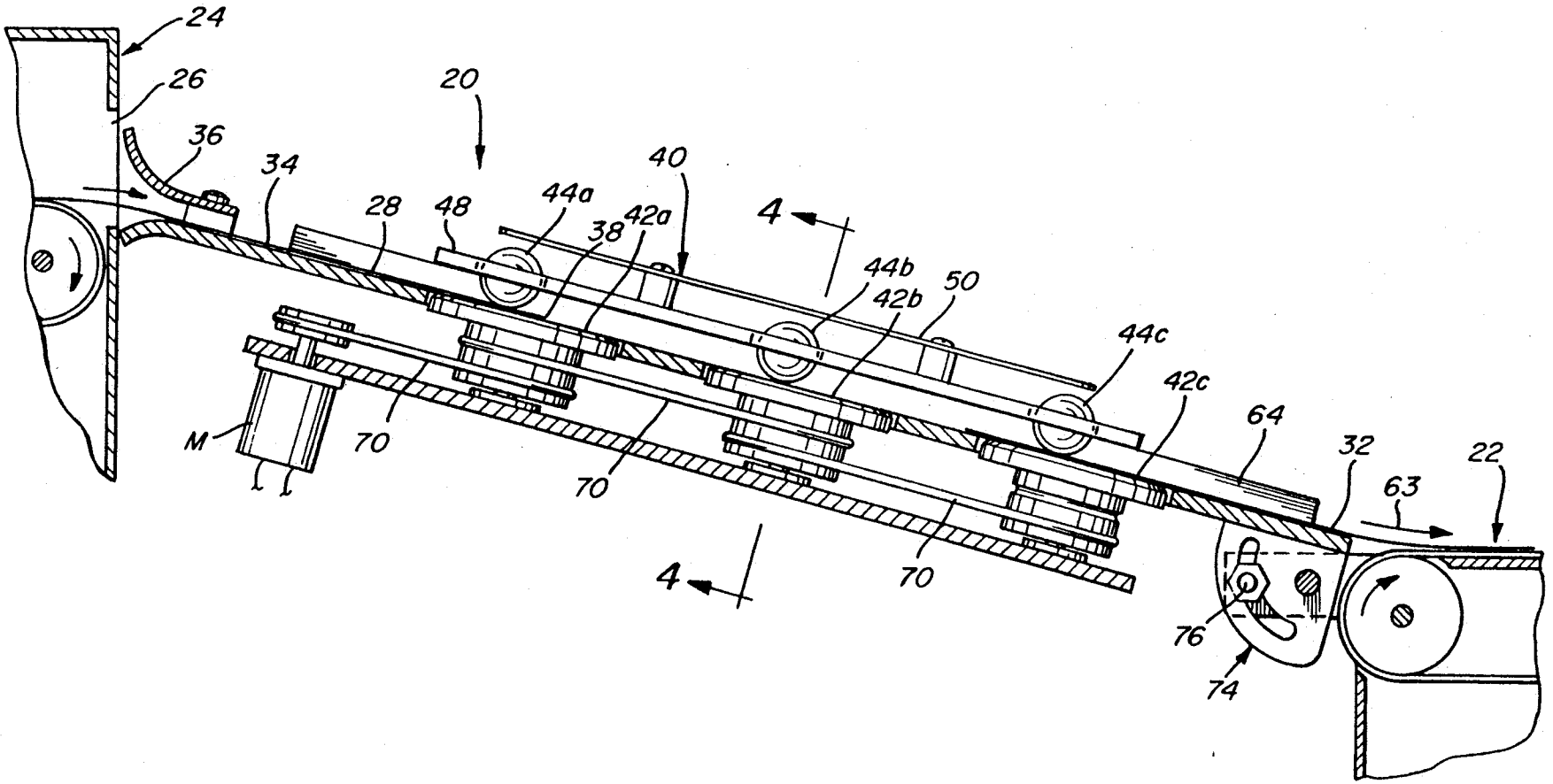
FIG. 3 is a cross-sectional side view of the sheet justifier taken along the line 3—3 of FIG. 2.
Figure 4:
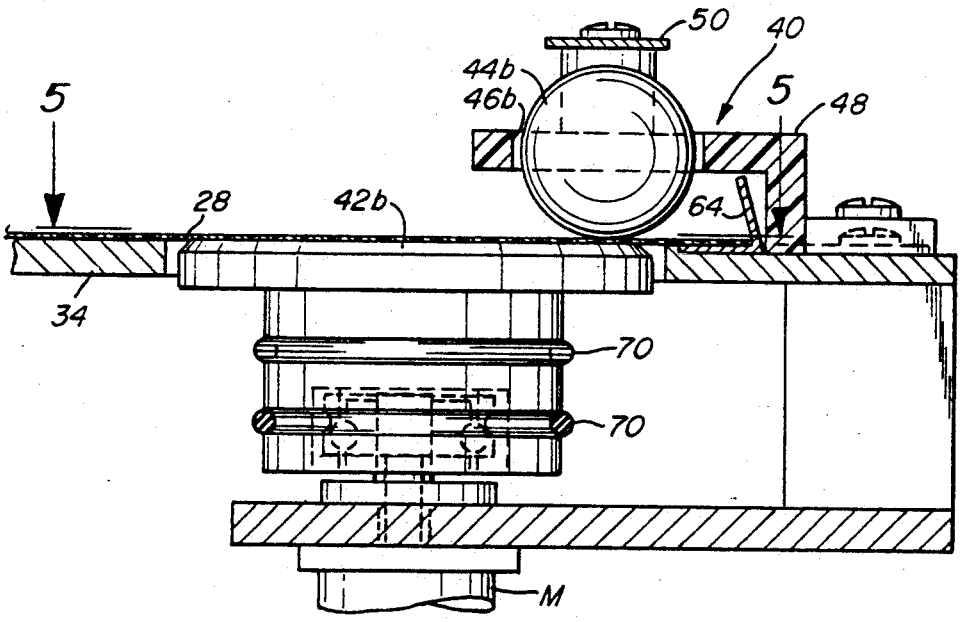
FIG. 4 is a partial cross-sectional rear view of the sheet justifier viewed in an upstream direction detailing the rotating disk and ball structure.

FIGS. 1–4 detail a sheet justifier 20 according to this invention. The sheet justifier 20 is mounted on a utilization device 22 positioned downstream of another device 24 such as a printer having a port 26 that ejects sheets therefrom in a serial manner. As noted above, it is normally desirable to accurately register a sheet leaving a port and entering a utilization device 22. In this example, a sheet 28 has been output from the upstream port 26 in a somewhat crooked orientation (note the justified orientation of the sheet 30 shown in phantom). Without the use of a sheet justifier, the crooked sheet 28 would most likely jam or otherwise cause a defective output at the utilization device 22. The sheet justifier 20 in this embodiment straightens the sheet 28 so that it enters the utilization device 22 in a proper parallel orientation as exemplified by the downstream sheet 32.

The justifier 20 comprises a feeding table 34 constructed, for example, of sheet metal and defining a substantially flat surface over which sheets can pass. The table 34 has a funnel structure 36 at its upstream end. The funnel structure 36 helps to insure that the sheet leading edge 38 is guided onto the table surface of the justifier 20 as it exits the port, The crooked sheet 28 is driven out of the port under the driving power of the upstream device 24 approximately until it reaches the justifier mechanism 40. At such a time, the leading edge 38 of the sheet 28 is engaged by the justifier mechanism 40 and the sheet is moved into justified registration.

The justifier mechanism 40 according to this embodiment comprises three rotating disks 42*a–c* that have surfaces positioned approximately on level with the justifier table 34 through holes 46*a–c* provided in the table surface. While circular disks 42*a–c* are employed in this example, a variety of geometric shapes can be utilized and are contemplated according to this invention. Each disk 42*a–c* includes at a position over its surface a weighted ball 44*a–c* that comprises, in this example, a three-quarter inch diameter ball bearing that bears against the rotating disk surface. It is between the ball bearing and the disk that the leading edge of the sheets are grasped by the mechanism and it is by means of the positional interrelationship between the weighted ball bearing and the disk that the sheets are brought into registered alignment. While a ball bearing is used according to this embodiment, it should be understood that "ball" as used herein shall refer to any structure that rotates freely and/or can resolve rotation into two or more degrees of freedom to follow the movement of a sheet thereunder, such as a roller on gimbles (not shown).

Each ball bearing 44*a–c* is, itself, mounted within a corresponding hole 46*a–c* in a framework 48 that allows the balls 44*a–c* to rotate in all degrees of freedom. A bar 50 can be provided on the framework 48 above the ball bearings 44*a–c* to prevent them from popping out of their holes 46*a–c* in the framework 48. Space should be provided between the bar 50 and the top of each ball bearing 44*a–c* so that a large variation in thicknesses of sheets can be accommodated by the justifier mechanism 40 without causing the ball bearing tops to rub against the bar 50.

Figure 5:
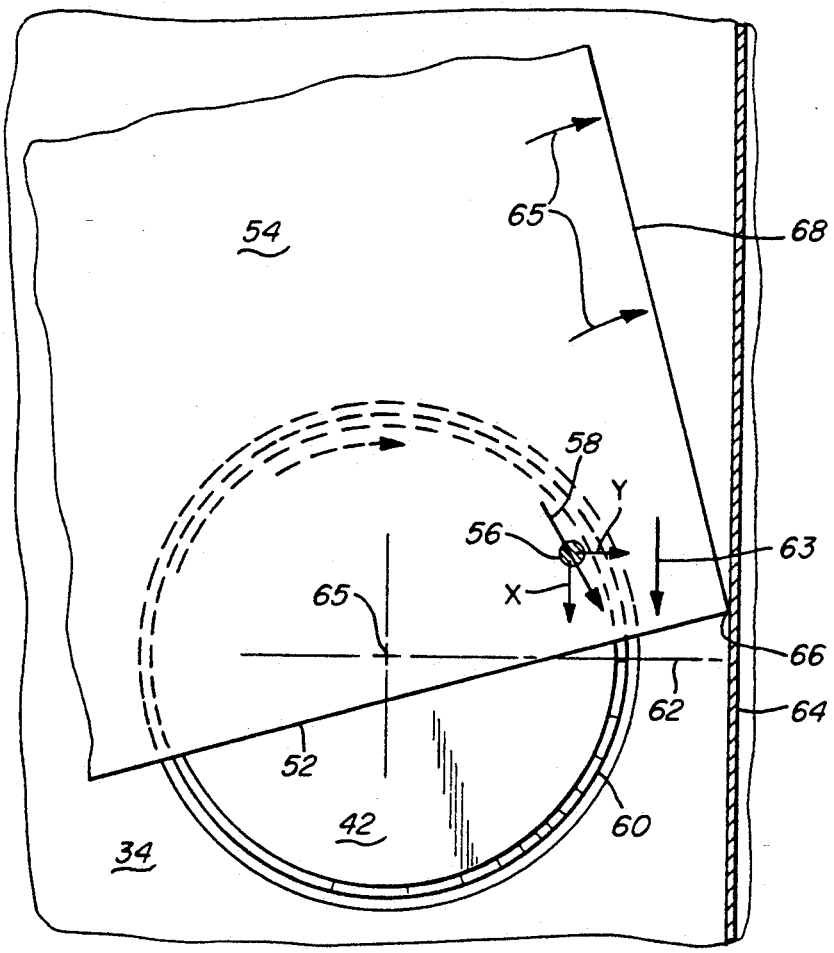
FIG. 5 is a somewhat schematic top view illustrating the justification of a sheet by a rotating disk and ball according to this invention.

Referring now to FIG. 5, it illustrates the principle governing the justification of sheets according to this invention. When the leading edge 52 of a sheet 54 is grasped between the ball bearing 44 and the moving surface of disk 42, the friction of the disk surface proximate the contact point 56 of the ball bearing 44 causes an immediate tangential movement of this sheet 54 relative to the disk 42 as shown by the arrow 58. The ball bearing (not shown) serves to concentrate the grip of the sheet 54 by the disk 42 at the contact point 56 while the remaining disk surface slides relative to the sheet. Thus, the sheet 54 is driven by the localized movement of the disk 42 at the contact point 56. The contact point 56 of the ball bearing 44 in this embodiment should be placed near the outer edge 60 of the disk 42 and upstream of a line 62 taken through the center axis 65 of the disk and perpendicular to the direction of the sheet flow shown by the arrow 63. In this embodiment, a 2½ to 3 inch disk can be utilized in which the contact point is positioned ½ to 1 inch upstream of the diameter line 62.

The sheet justifier 20 according to the embodiment of FIGS. 1–4 and as shown in FIG. 5 includes a raised vertical edge guide 64 running almost the full length of the table 34. The edge guide 64 is parallel to the direction of sheet flow (arrow 63). The edge guide 64 slants inwardly toward the sheets in this embodiment to maintain the edges of sheets moving therealong firmly against the table surface. As shown in FIG. 5, the raised edge guide is a block that prevents the corner 66 of the sheet 54 from moving further along the tangent (arrow 58) direction of disk rotation. As such, as the disk continues to rotate, the sheet is, itself, caused to rotate (arrows 65) inwardly toward the raised edge guide 64. This is because the sheet is driven almost entirely at the contact point of the ball bearing. The rotationally generated tangential force of the disk can be resolved into perpendicular force vectors X and Y emanating from the contact point as shown. The force vector Y perpendicular to the edge guide 64 causes the sheet to move its side edge 68 into contact with the raised edge guide 64. Simultaneously, the force vector X causes sheet motion along the flow direction (arrow 63). Since sheet movement generated by the force vector Y is blocked by the edge guide 64 once the sheet edge 68 has moved fully into contact with the edge guide 64, only the downstream directed vector X can act upon the sheet once it has rotated against the edge guide 64.

Figure 6:
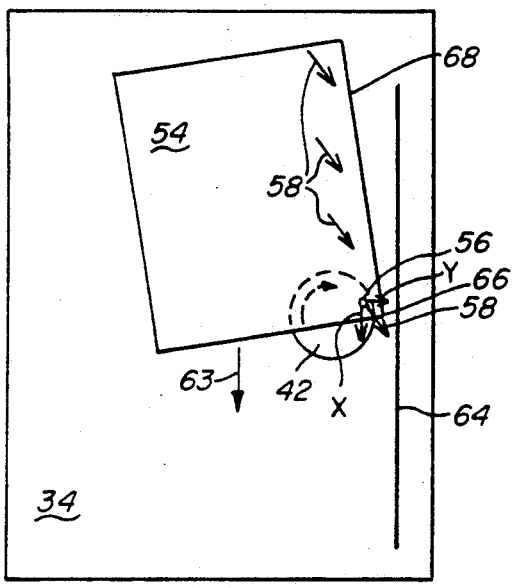
FIGS. 6–9 are somewhat schematic top views of a justification sequence for a sheet using a rotating disk and ball structure according to this invention.

The full sequence of sheet justification is further detailed in FIGS. 6–9. A sheet 54 starts in a spaced apart relation from the raised edge guide 64 in FIG. 6. At this time, the sheet 54 moves along a direction of tangent to the rotation of the disk 42 (arrow 58) relative to the contact point 56 (FIG. 6).

Figure 7:
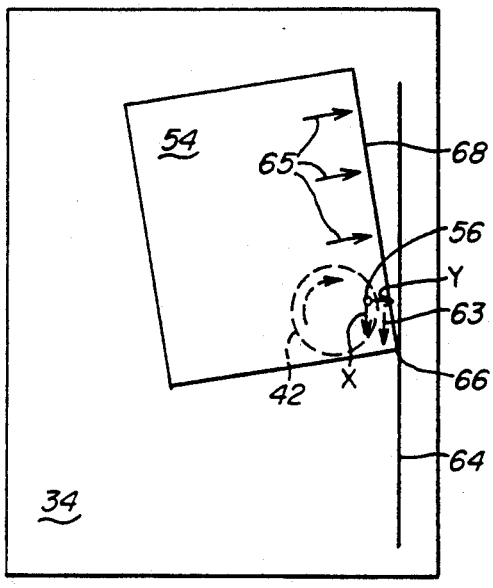
Figure 8:
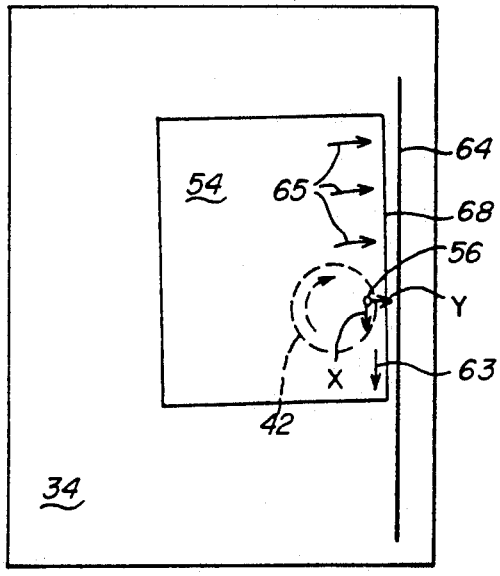
Figure 9:
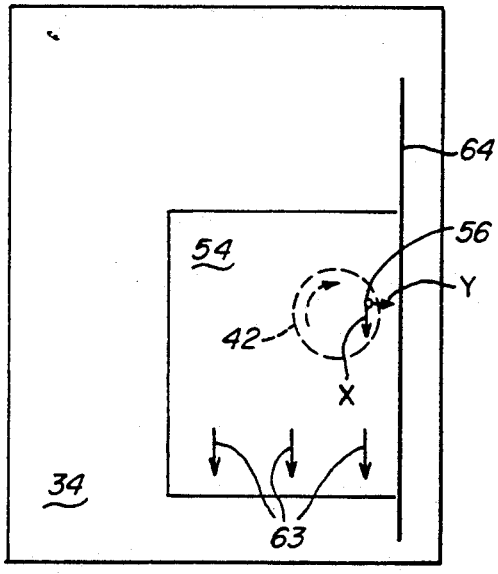

In FIG. 7, the leading corner 66 of the sheet 54 has reached the edge guide 64 and tangential movement is no longer possible, at this time, the perpendicular force vector Y serves to rotate the upstream portion of the sheet side edge 68 toward the raised edge guide 64 as shown by the arrows 65. The movement of the side edges toward the raised edge continues in FIG. 8 until, finally, in FIG. 9 the sheet is brought fully into contact with the raised edge guide without further movement. Only the downstream vector X can act on the sheet at this time since the perpendicular vector Y is forcing the sheet fully against the raised edge guide 64.

The spacing of the raised edge guide 64 from the disk 42 and contact point 56 should be such that the sheet 54 cannot buckle therebetween in spite of the force generated by the perpendicular vector Y. This distance value will vary, therefore, based upon the coefficient friction of the disk surface, the weight of the ball, the general stiffness of the sheet stock utilized and the inward slant of the raised edge guide 64. In other words, for very high friction surface or very thin sheet stock, the spacing between the raised edge guide 64 and the contact point 56 must be fairly close to prevent buckling. Conversely, for thicker sheet stock and/or a lower friction surface, a larger spacing can be tolerated.

In this embodiment, the disk surface includes a polyurethane coating that provides a reasonably good frictional contact with the sheets but that also allow some slippage so that sheets do not tend to buckle at the raised edge. A variety of friction enhancing surface coatings and materials are contemplated.

Referring once again to FIGS. 1–4, the justifier mechanism 40 according to this embodiment includes three rotating disks 42*a–c* aligned along the direction of sheet flow and equally spaced from the raised edge guide 64. Once a sheet is justified against the raised edge guide 64 (usually by the upstream most disk 42*a*), the two more downstream disposed disks 42*b–c* simply maintain it forcibly against the raised edge guide 64 as it is motioned downstream into the utilization device 22. The three disks 42*a–c* in this embodiment are each interlinked by drive belts 70 to a central drive motor M. Thus, all disks 42*a–c* rotate at essentially the same angular velocity.

The sheet justifier 20 according to this invention can be mounted as a free standing portable unit or, as in this embodiment, on brackets 74 that are connected to the utilization device 22. The brackets 74 in this embodiment include adjustment controls 76 for changing the elevation of the upstream funnel 36 relative to access output ports of varying elevations. In this manner, the justifier can accept sheets from a variety of ports on a variety of devices. The port can, in fact, be below the utilization device, on level with the device or above it. The justifier can transfer sheets in any of these orientations.

Figure 10:
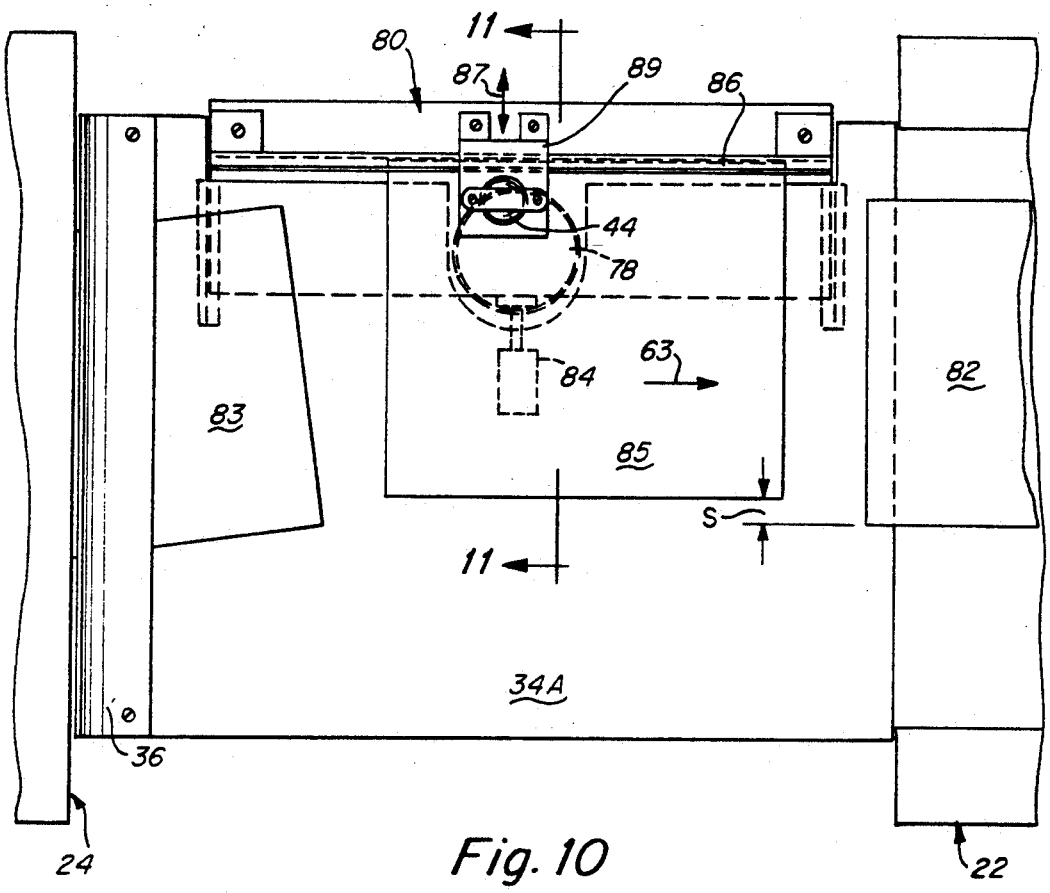
FIG. 10 is an exposed top view of a sheet justifier according to an alternative embodiment of this invention.
Figure 11:
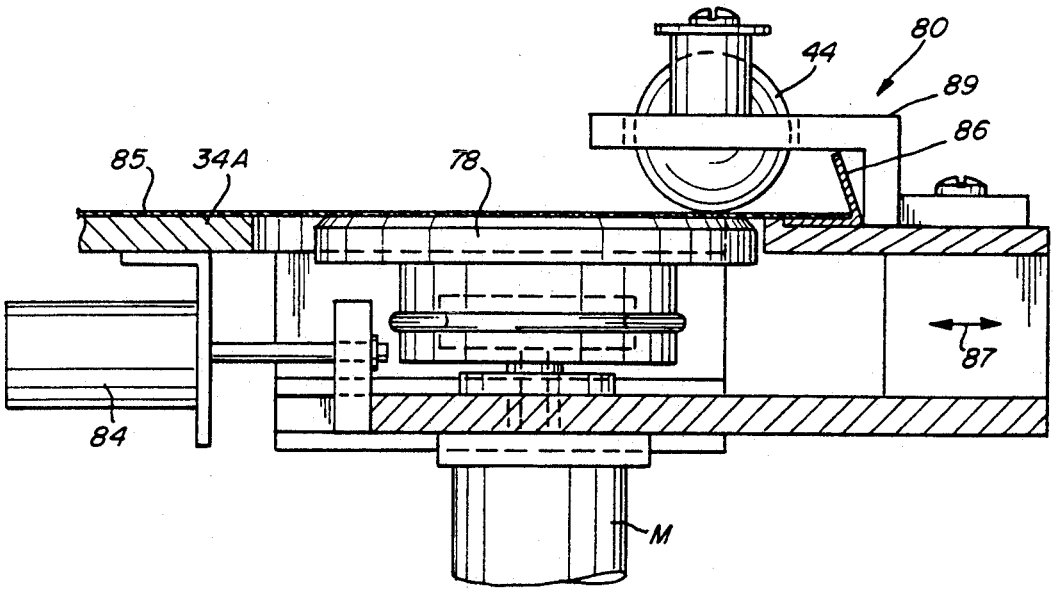
FIG. 11 is a partial cross-sectional rear view of the sheet justifier viewed in an upstream direction taken along line 11—11 of FIG. 10.

FIGS. 10 and 11 detail a sheet justifier according to an alternative embodiment of this invention. As noted above, a plurality of rotating disks can be utilized with any embodiment herein. In this embodiment, only one disk 78 has been employed. This embodiment further includes a moving justifier mechanism 80 to produce jog offset sheets (such as downstream sheet 82) at selected times from input unjustified sheets 83. Sheets are normally aligned and justified as shown by sheet 85. In order to offset justified sheets, the mechanism moves transversely to the direction of sheet flow as shown by the arrow 87 for a distance S. Movement can be accomplished by means of a linear actuator 84 as shown, or by a similar mechanism. In this embodiment, the entire justifier mechanism 80, including the disk 85, its motor M, the ball 44 and framework 89 and edge guide 86, moves relative to the table 34A to produce jog offset sheets. Such movement can be advantageous where the spacing between the raised edge guide 86 and the contact point of the ball 44 must be fairly constant. Alternatively, the edge guide 86 can, itself be movable while the disk 78 and weighted ball 44 remain stationary. As long as the spacing between the ball's contact point on the disk and the position of the edge guide remain, at all times, within an acceptable spacing range to prevent sheet buckling, then jog offset sheets can be produced by moving only the raised edge guide 86.

Figure 12:
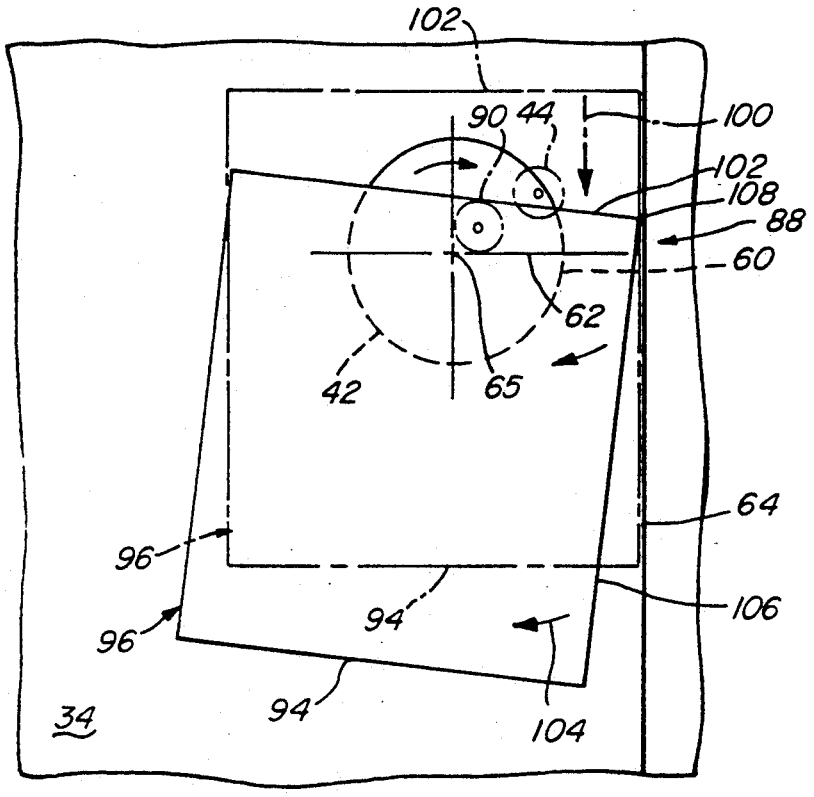
FIGS. 12 and 13 are schematic top views of a sheet justifier according to yet another alternative embodiment of this invention for enabling rotation of sheets.
Figure 13:
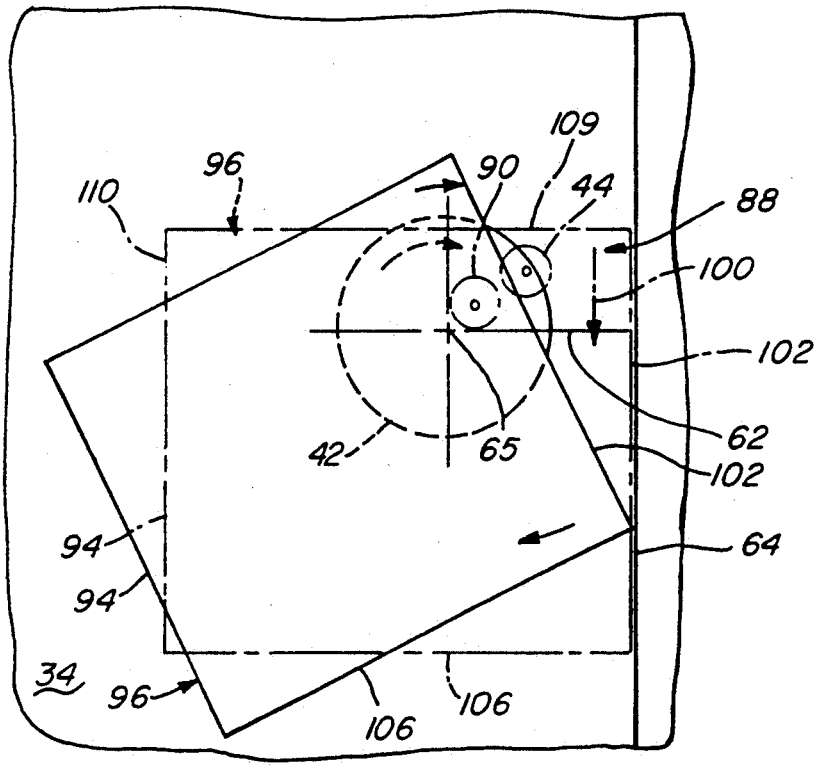

A further improvement according to this invention is depicted in FIGS. 12–13. The sheet justifier mechanism 88 according to this embodiment can be adapted to rotate sheets through 360° and select any sheet edge for justification. The mechanism comprises a disk 42 such as that utilized in the above-described embodiments. There is a first weighted ball 44 positioned proximate the disk outer edge 60 in essentially the same location as that shown in the above described embodiments (e.g. upstream of the perpendicular diameter line 62). The mechanism 88 according to this embodiment further includes a second weighted ball 90 positioned somewhat closer to the center rotational axis 65 of the disk 42, upstream of the perpendicular diameter line 62, but downstream of the first weighted ball 44. The first more outwardly disposed ball 44 engages the leading edge 94 of the sheet 96 in a manner similar to that of the above described embodiments. The sheet 96 is justified by the first ball 44 in a relatively normal manner. The sheet 96 is driven as shown by phantom sheet 96 downstream against the edge guide 64 by a downstream vector 100 generated by the first ball 44 until its trailing edge 102 passes out of the first ball's point of contact (solid sheet 96 of FIG. 12). Throughout the driving of the sheet 96, the second more inwardly disposed ball 90 does not substantially affect the driving of the sheet along the raised edge guide 64.

However, once the trailing edge 102 of the sheet passes out of the first ball's contact point, the second ball 90 alone creates a second differently acting set of driving force vectors. The second ball's driving force, owing to its proximity to the rotational axis 65 of the disk 42, is more rotational and less tangential and, hence, causes the downstream part of the sheet's side edge 106 to rotate (arrows 104) about its upstream corner 108 away from contact with the raised edge guide 64. Accordingly, the sheet rotates (solid sheet 96 of FIG. 13) with the second ball 90 so that its (former) trailing edge 102 now engages the raised edge guide 64 as illustrated by the phantom sheet 96 in FIG. 13. The rotated sheet 96 is now brought back into contact with the first more outwardly disposed ball 44. Thus, it is again moved in a downstream direction (arrow 100) along the raised edge guide 64 until the new trailing edge 109 again disengages from the first ball 44. The sheet then again rotates as shown in FIGS. 12 and 13 so that the next edge 110 is brought into contact with the raised edge guide 64. The sheet continues to rotate as long as the second more inwardly disposed ball 90 is in place.

In a practical application, the second ball 90 can include a lifting mechanism, such as a magnet (not shown), that disengages the second ball 90 from contact with the sheet once a desired sheet edge has been brought into contact with the raised edge guide 64. Since the second ball 90 is no longer in contact with the sheet at this time, the sheet is free to travel directly downstream through the justification mechanism into the utilization device without rotating.

Hence, an input sheet can be rotated at selected times by dropping the second more inwardly disposed ball 90 while the sheet is being driven through the mechanism 88. The sheet then rotates through the desired number of edges, until the proper rotation has been achieved. At this time, the ball 90 can be lifted from contact with the sheet to allow the sheet to pass on into the next device with the desired rotational orientation.

The foregoing has been a detailed description of some possible embodiments of the invention. Various modifications and equivalents are contemplated without departing from the spirit and scope of this invention. For example, while square and rectangular sheets are illustrated herein, justification of non-rectangular, polygonal, sheets is contemplated. The justifier according to this invention requires only a relatively straight sheet edge to engage the raised edge guide. Accordingly, this description is meant to be taken only by way of example and not to otherwise limit the scope of the invention.

What is claimed is:

1. A sheet justifier comprising:

a supporting surface for supporting sheets, the supporting surface having an upstream end for receiving the sheets and a downstream end for outputting the sheets;

a raised edge guide extending in a line substantially from the upstream end to the downstream end of the supporting surface, the edge guide being aligned substantially along the downstream direction and being substantially free of gaps along a length thereof in the upstream to downstream direction;

a plurality of rotating surfaces, each of the surfaces being located in an aperture on the supporting surface and each of the rotating surfaces being approximately coplanar with the supporting surface each rotating surface rotating in the same rotational direction on an axis substantially perpendicular to the supporting surface, each axis being aligned along a line that is substantially parallel to the line defined by the edge guide;

a plurality of balls each contacting a respective one of the plurality of rotating surfaces and rotating therewith, each ball having a contact point on the respective rotating surface that is positioned between the raised edge guide and the axis of rotation of the respective rotating surface, the contact point being remote from the axis of rotation and the contact point being upstream from a line perpendicular to the edge guide taken through the respective axis of rotation; and a frame suspended over the raised edge guide and over each of the plurality of rotating surfaces, the frame including a plurality of apertures that retain each of the plurality of balls therein, the apertures enabling the balls to rotate freely in all degrees of freedom.

2. A sheet justifier as set forth in claim 1 wherein the rotating surfaces each comprise a disk.

3. A sheet justifier as set forth in claim 1 further comprising a funnel positioned at the upstream end of the supporting surface, the funnel guiding sheets from a point remote from the supporting surface onto the supporting surface.

4. A sheet justifier as set forth in claim 1 further comprising mounting means for attaching an end of the supporting surface to a device for processing sheets.

5. A sheet justifier as set forth in claim 4 wherein the mounting means includes a pivot mechanism to enable pivoting of an end of the supporting surface so that an opposing end of the supporting surface can be located at variable elevations.

6. A sheet justifier comprising:

a supporting surface for supporting sheets and having an upstream end for receiving the sheets and a downstream end for outputting the sheets;

a rotating surface approximately coplanar with the supporting surface and adjacent the supporting surface, the rotating surface rotating on an axis substantially perpendicular to the supporting surface;

a raised edge guide positioned proximate the rotating surface for guiding an edge of sheets moving therealong;

a structure that moves the raised edge guide relative to the supporting surface to offset sheets moving therealong; and a ball contacting the rotating surface and rotating therewith, the ball having a contact point on the rotating surface positioned between the raised edge and the axis of rotation, the contact point being remote from the axis of rotation, the contact point being upstream from a line perpendicular the edge guide taken through the axis.

7. A sheet justifier as set forth in claim 6 wherein the supporting surface includes an orifice in which the disk is positioned and wherein the raised edge guide is located along an edge of the supporting surface.

8. A sheet justifier as set forth in claim 7 further comprising a plate positioned over the disk and having an opening sized to hold the ball and allowing the ball to rotate in all degrees of freedom.

9. A sheet justifier as set forth in claim 8 wherein the raised edge includes a slant directed inwardly toward the supporting surface from the edge thereof.

10. A sheet justifier as set forth in claim 9 wherein the disk includes a frictional coating thereon.

11. A sheet justifier as set forth in claim 6 comprising a plurality of rotating surfaces each having a ball in contact therewith positioned along a predetermined direction of sheet flow upon the supporting surface.

12. A sheet justifier as set forth in claim 11 wherein the raised edge guide is positioned along the direction of sheet flow.

13. A sheet justifier as set forth in claim 6 further comprising a funnel positioned at the upstream end of the supporting surface, the funnel guiding sheets from a point remote from the supporting surface onto the supporting surface.

14. A sheet justifier as set forth in claim 6 further comprising mounting means for attaching an end of the supporting surface to a device for processing sheets.

15. A sheet justifier as set forth in claim 14 wherein the mounting means includes a pivot mechanism to enable pivoting of an end of the supporting surface so that an opposing end of the supporting surface can be located at variable elevations.

16. A sheet justifier comprising:

a supporting surface for supporting sheets and having an upstream end for receiving the sheets and a downstream end for outputting the sheets;

a rotating surface approximately coplanar with the supporting surface and adjacent the supporting surface, the rotating surface rotating on an axis substantially perpendicular to the supporting surface;

a raised edge guide positioned proximate the rotating surface for guiding an edge of sheets moving therealong;

a ball contacting the rotating surface and rotating therewith, the ball having a contact point on the rotating surface positioned between the raised edge and the axis of rotation, the contact point being remote from the axis of rotation, the contact point being upstream from a line perpendicular to the edge guide taken through the axis; and a second ball having a contact point on the rotating surface between the contact point of the ball and the axis of rotation so that upstream trailing edges of the sheets passing out of engagement with the ball are rotated by the second ball.

17. A sheet justifier as set forth in claim 16 wherein the second ball is movable into and out of engagement with the rotating surface so as to selectively rotate sheets thereby.

18. A method for justifying sheets comprising:

transferring sheets along a supporting surface to a rotating surface positioned proximate a raised edge guide, the rotating surface including a freely rotating mass positioned thereover and engaging the rotating surface remote from an axis of rotation thereof;

engaging the sheet between the rotating surface and the rotating mass;

driving the sheet by the step of engaging against a raised guide edge wherein the rotating mass resolves rotation of the rotating surface into a first driving force biasing the sheet against the edge and a second driving force driving the sheet along the edge; and

19. A method as set forth in claim 18 further comprising driving the sheet into a plurality of rotating surfaces having freely rotating masses positioned thereover to drive the sheet further along the guide edge.

20. A method for justifying sheets comprising:

transferring sheets along a supporting surface to a rotating surface positioned proximate a raised edge guide, the rotating surface including a freely rotating mass positioned thereover and engaging the rotating surface remote from an axis of rotation thereof;

engaging the sheet between the rotating surface and the rotating mass;

driving the sheet by the step of engaging against a raised guide edge wherein the rotating mass resolves rotation of the rotating surface into a first driving force biasing the sheet against the edge and a second driving force driving the sheet along the edge; and providing a second freely rotating mass between the freely rotating mass and the axis of rotation of the rotating surface at selected times so as to rotate the sheet relative to the guiding edge.

* * * * *